US012747607B2

(12) United States Patent
Chou et al.

(10) Patent No.: US 12,747,607 B2
(45) Date of Patent: Sep. 29, 2026

(54) SELF-CENTERING ENERGY DISSIPATION DEVICE AND WALL DAMPING ASSEMBLY

(71) Applicant: NATIONAL APPLIED RESEARCH LABORATORIES, Taipei City (TW)

(72) Inventors: Chung-Che Chou, Taipei City (TW); Li-Yu Huang, Taichung City (TW)

(73) Assignee: NATIONAL APPLIED RESEARCH LABORATORIES, Taipei City (TW)

( * ) Notice: Subject to any disclaimer, the term of this patent is extended or adjusted under 35 U.S.C. 154(b) by 127 days.

(21) Appl. No.: 18/817,610

(22) Filed: Aug. 28, 2024

(65) Prior Publication Data

US 2025/0243683 A1 Jul. 31, 2025

(30) Foreign Application Priority Data

Jan. 29, 2024 (TW) ..... 113103308

(51) Int. Cl.
*E04H 9/02* (2006.01)

(52) U.S. Cl.
CPC ..... *E04H 9/02* (2013.01)

(58) Field of Classification Search
CPC ..... E04H 9/021; E04H 9/0215; E04H 9/0237; E04H 9/02
See application file for complete search history.

(56) References Cited

U.S. PATENT DOCUMENTS

2018/0209134 A1* 7/2018 Calderon Uriszar-Aldaca ..... E04B 1/043
2021/0123257 A1* 4/2021 Mohammadi Darani ..... F16F 7/09

FOREIGN PATENT DOCUMENTS

| | | | | |
|---|---|---|---|---|
| CN | 105672520 A | * | 6/2016 | ..... E04H 9/0215 |
| CN | 106223696 A | * | 12/2016 | ..... E04H 9/021 |
| CN | 105350679 B | * | 6/2017 | ..... E04B 1/98 |
| CN | 106567324 B | * | 6/2018 | ..... E01D 19/00 |
| CN | 108999305 B | * | 5/2020 | ..... E04H 9/021 |
| CN | 109853770 B | * | 2/2021 | |

* cited by examiner

*Primary Examiner* — Christine T Cajilig
(74) *Attorney, Agent, or Firm* — Morse, Barnes-Brown & Pendleton, P.C.; Erin E. Bryan, Esq.; Russell L. Widom

(57) ABSTRACT

A self-centering energy dissipation device is adapted to be connected to first and second objects, and includes a first base seat, at least one main shaft, two second base seats and at least one pair of elastic members. The first base seat is adapted to be connected to the first object. The at least one main shaft extends through the first base seat. The second base seats are connected respectively and movably to two opposite ends of the at least one main shaft and are adapted to be connected to the second object. The at least one pair of elastic members are sleeved on the at least one main shaft. Each of the at least one pair of elastic members has a first end abutting against the first base seat, and a second end abutting against a respective one of the second base seats.

12 Claims, 11 Drawing Sheets

SELF-CENTERING ENERGY DISSIPATION DEVICE AND WALL DAMPING ASSEMBLY

CROSS-REFERENCE TO RELATED APPLICATION

This application claims priority to Taiwanese Invention Patent Application No. 113103308, filed on Jan. 29, 2024, the entire disclosure of which is incorporated by reference herein.

FIELD

The disclosure relates to a damping device, and more particularly to a damping device for use in an architectural structure.

BACKGROUND

Since earthquakes often cause losses of life and properties, many researches has developed on energy dissipating members with the advancement of science and technology. However, such energy dissipating members usually have a relatively low post-yield stiffness and a relative large amount of plastic energy dissipation as being subjected to impact of earthquakes, resulting in a relatively large residual deformation or concentrated damage thereto after earthquakes.

SUMMARY

Therefore, an object of the disclosure is to provide a self-centering energy dissipation device that can alleviate at least one of the drawbacks of the prior art.

According to the disclosure, a self-centering energy dissipation device is adapted to be connected to a first object and a second object. The self-centering energy dissipation device includes a first base seat, at least one main shaft, two second base seats and at least one pair of elastic members. The first base seat is adapted to be connected to the first object. The at least one main shaft extends through the first base seat. The second base seats are connected respectively and movably to two opposite ends of the at least one main shaft and are adapted to be connected to the second object. The at least one pair of elastic members are sleeved on the at least one main shaft. Each of the at least one pair of elastic members has a first end abutting against the first base seat, and a second end abutting against a respective one of the second base seats.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
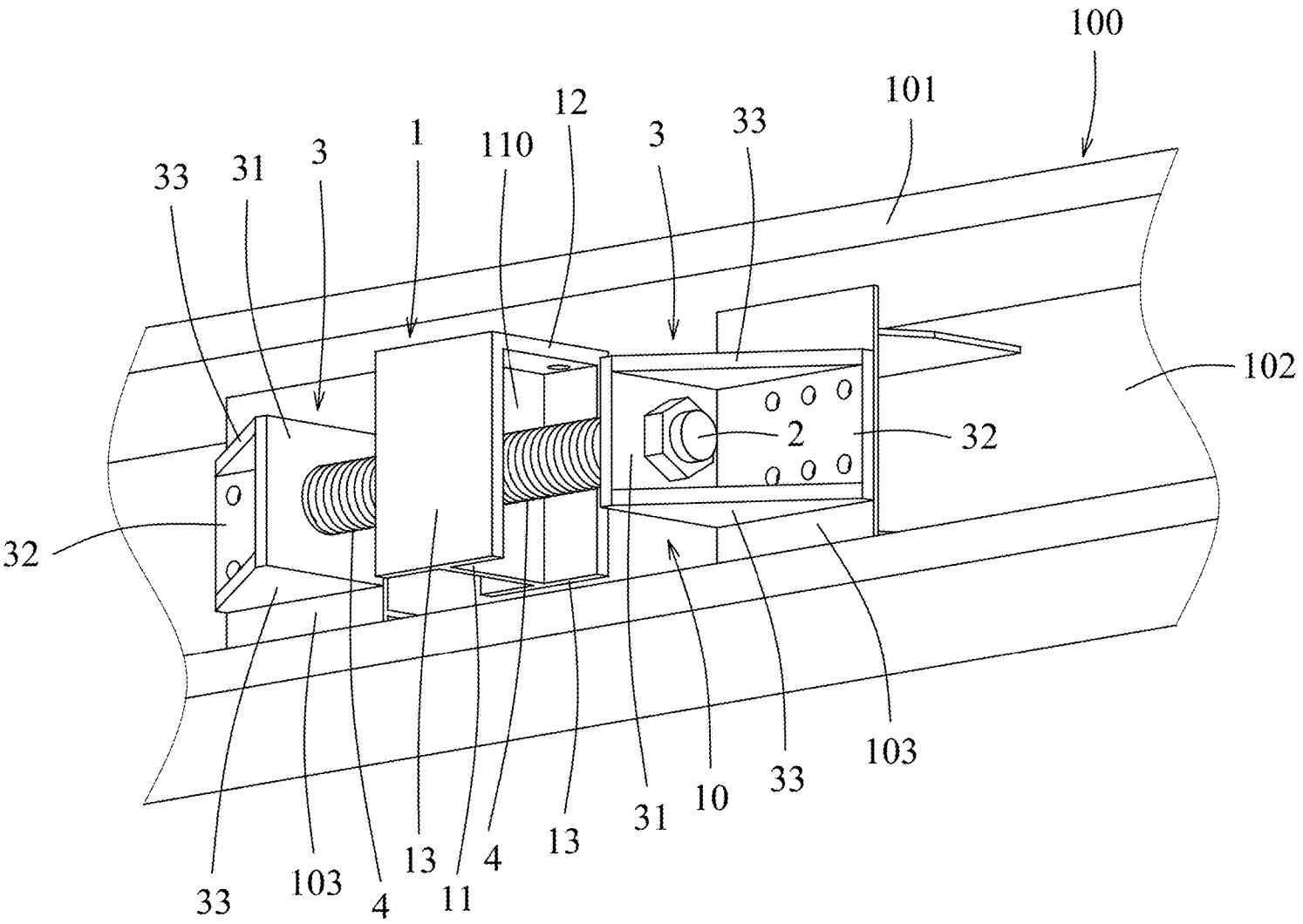
FIG. 1 is a perspective view of a self-centering energy dissipation device of a first embodiment according to the present disclosure mounted to a precast slide floor slab.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
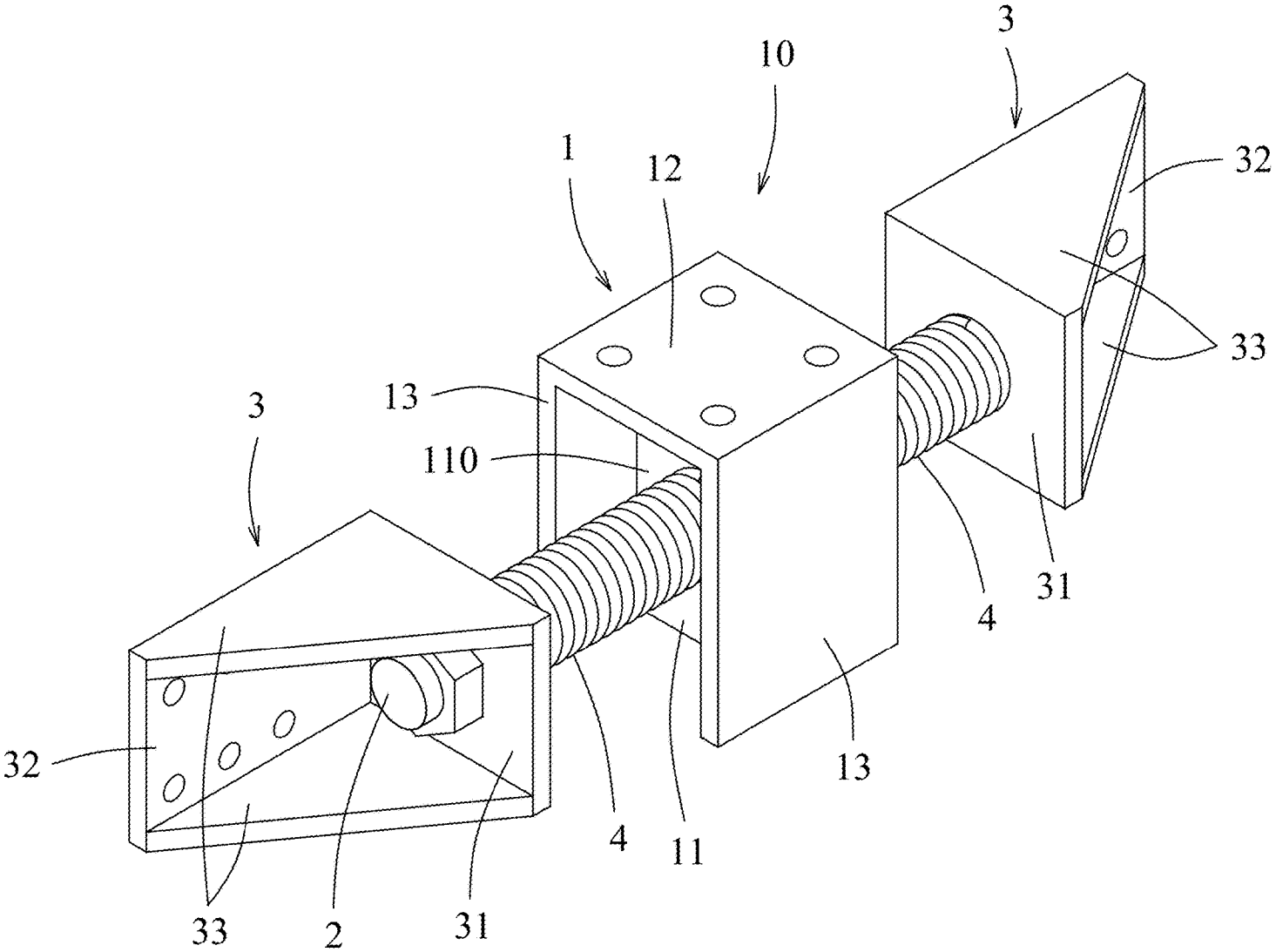
FIG. 2 is a perspective view of the first embodiment.

Referring to FIGS. 1 and 2, a self-centering energy dissipation device 10 of a first embodiment according to the present disclosure is adapted to be used in a precast slidable floor slab 100 in a building. The precast slidable floor slab 100 includes a top wall 101, an beam 102 connected perpendicularly to the top wall 101, and two mounting frames 103 mounted to the beam 102 and spaced apart from each other in a first direction. In this embodiment, the top wall 101 serves as a first object, and the beam 102 serves as a second object. The self-centering energy dissipation device 10 includes a first base seat 1, a main shaft 2, two second base seats 3, and a pair of elastic members 4.

The first base seat 1 is substantially a rectangular cuboid, and includes an abutment wall 11 permitting the main shaft 2 to extend therethrough, a first attaching wall 12 transverse to the abutment wall 11, and two lateral walls 13 transverse to the abutment wall 11 and the first attaching wall 12. The abutment wall 11 has two abutment surfaces 110 opposite along the main shaft 2 and facing respectively the second base seats 3. The first attaching wall 12 is connected to one side of the abutment wall 11 and is adapted to be connected to the top wall 101. The lateral walls 13 are connected to two sides of the abutment wall 11 that are opposite in a direction transverse to the main shaft 2 and two sides of the first attaching wall 12 that are opposite in the direction transverse to the main shaft 2. The main shaft 2 extends through the first base seat 1. The second base seats 3 are connected respectively and movably to two opposite ends of the main shaft 2 and are adapted to be connected to the beam 102.

Each of the second base seats 3 is substantially a triangular prism, and includes a connecting wall 31 connected to the main shaft 2, a second attaching wall 32 transverse to and connected to the connecting wall 31, and two sidewalls 33 connected to two sides of the connecting wall 31 that are opposite in a direction transverse to the main shaft 2, and two sides of the second attaching wall 32 that are opposite in the direction transverse to the main shaft 2. The sidewalls 33 are substantially triangular. The second attaching walls 32 are connected respectively to the mounting frames 103 and thus the mounting frames 103 are connected respectively to the sidewalls 33. It should be noted that, each of the sidewalls 33 that the second attaching walls 32 are respectively connected to, inclines relative to the top wall 101 that the first attaching wall 12 is connected to by 90 degrees. That is to say, the first attaching wall 12 is perpendicular to each of the second attaching walls 32. The pair of elastic members 4 are sleeved on the main shaft 2. Each of the elastic members 4 has a first end abutting against a respective one of the abutment surfaces 110 of the abutment wall 11 of the first base seat 1, and a second end abutting against the connecting wall 31 of a respective one of the second base seats 3. In a case where an earthquake occurs, by virtue of the elastic members 4 that abut against the first base seat 1 and the second base seats 3, even if the first base seat 1 and each of the second base seats 3 are moved relative to each other during the earthquake, the first base seat 1 and the second base seats 3 may return to their initial positions, such that permanent deformation of the top wall 101 and the beam 102 would be less likely to occur, and relative movements between the first base seat 1 and each of the second base seats 3 dissipate a portion of earthquake energy exerted thereon during the earthquake.

Each of the elastic members 4 may be one of a disc spring, a coil spring, an automotive spring, and a compression spring. Since a disc spring may be adjusted to provide different bearing pressure and axial stiffness as required, a disc spring is employed as each of the elastic members 4 in this embodiment. It should be noted that each of the elastic members 4 mounted between the first base seat 1 and the respective one of the second base seats 3 is preloaded to provide a restoring force that facilitates the top wall 101 connected to the first base seat 1 and the respective one of the mounting frames 103 connected to the respective one of the second base seats 3 to return to their initial positions after earthquakes.

Figure 3:
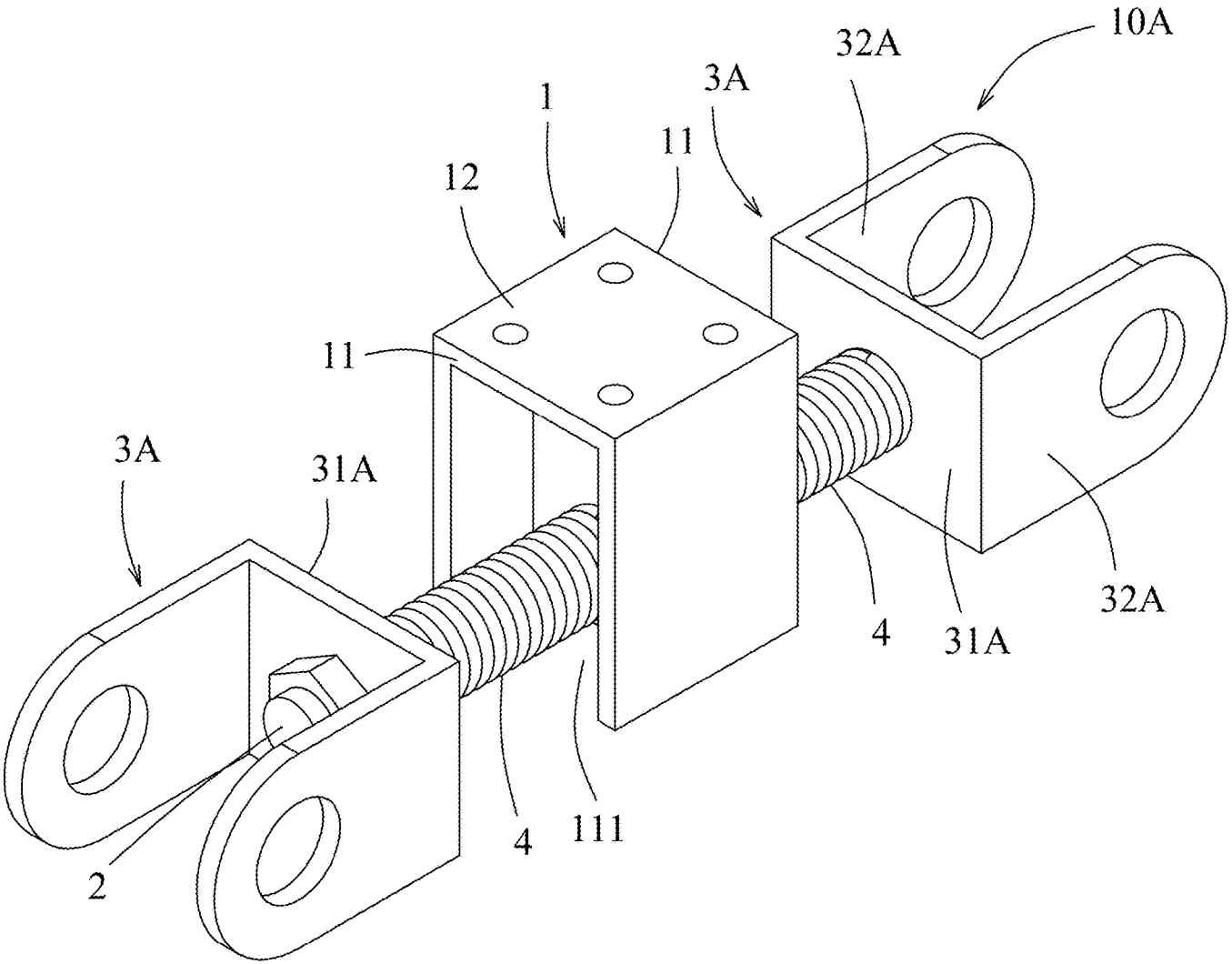
FIG. 3 is a perspective view of a self-centering energy dissipation device of a second embodiment according to the present disclosure.

Referring to FIG. 3, a self-centering energy dissipation device 10A of a second embodiment according to the present disclosure is similar to the first embodiment, and the difference between the second embodiment and the first embodiment resides in a configuration of the second base seats 3. In the second embodiment, each of the second base seats 3A is substantially U-shaped, and includes a connecting wall 31A connected to the main shaft 2, and two second attaching walls 32A transverse to the connecting wall 31A and connected respectively to two sides of the connecting wall 31A that are opposite in a direction transverse to the main shaft 2.

Figure 4:
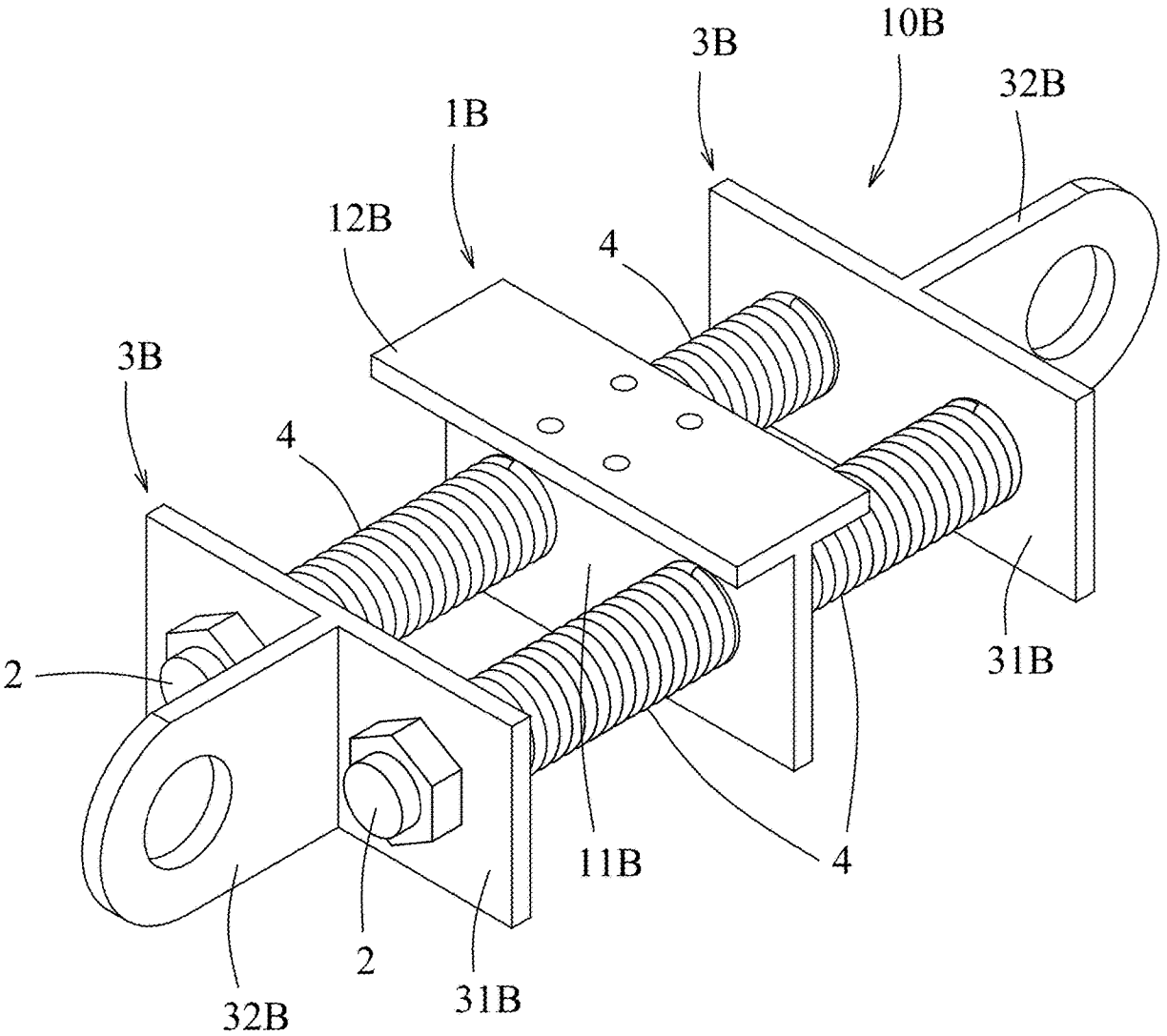
FIG. 4 is a perspective view of a self-centering energy dissipation device of a third embodiment according to the present disclosure.

Referring to FIG. 4, a self-centering energy dissipation device 10B of a third embodiment according to the present disclosure is shown. In the third embodiment, the self-centering energy dissipation device 10B includes a first base seat 1B, two main shafts 2, two second base seats 3B, and two pairs of elastic members 4. The first base seat 1B is substantially T-shaped, and includes an abutment wall 11B permitting the main shafts 2 to extend therethrough, and a first attaching wall 12B transverse to and connected to one side of the abutment wall 11B. Each of the second base seats 3B is substantially T-shaped, and includes a connecting wall 31B connected to the main shafts 2, and a second attaching wall 32B transverse to and connected to the connecting wall 31B. The main shafts 2 are connected in parallel between the second base seats 3B. The second attaching walls 32B are disposed between the main shafts 2. In this embodiment, the elastic members 4 of each pair are sleeved on a respective one of said main shafts 2, and the two pairs of the elastic members 4 are connected in parallel between the connecting walls 31B of the second base seats 3B, thus providing a relative high pressure bearing capability and a relative high axial stiffness.

Figure 5:
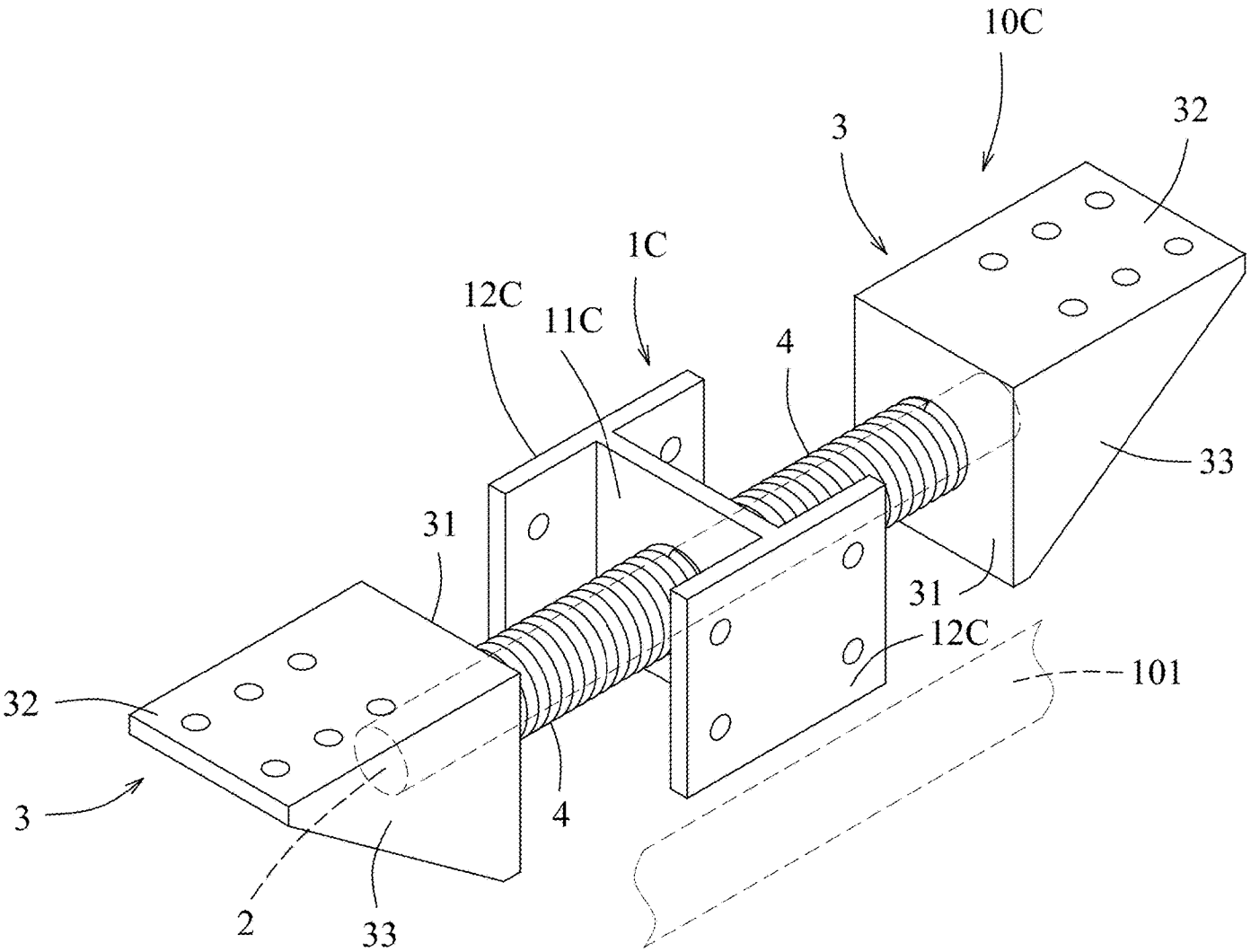
FIG. 5 is a perspective view of a self-centering energy dissipation device of a fourth embodiment according to the present disclosure.

Referring to FIG. 5, a self-centering energy dissipation device 10C of a fourth embodiment according to the present disclosure is similar to the first embodiment, and the difference between the fourth embodiment and the first embodiment resides in a configuration of the first base seat 1. In the fourth embodiment, the first base seat 1C is substantially H-shaped, and includes an abutment wall 11C permitting the main shaft 2 to extend therethrough, and two first attaching walls 12C connected respectively to two sides of the abutment wall 11C that are opposite in a direction transverse to the abutment wall 11C, and adapted to be connected to the top wall 101.

Figure 6:
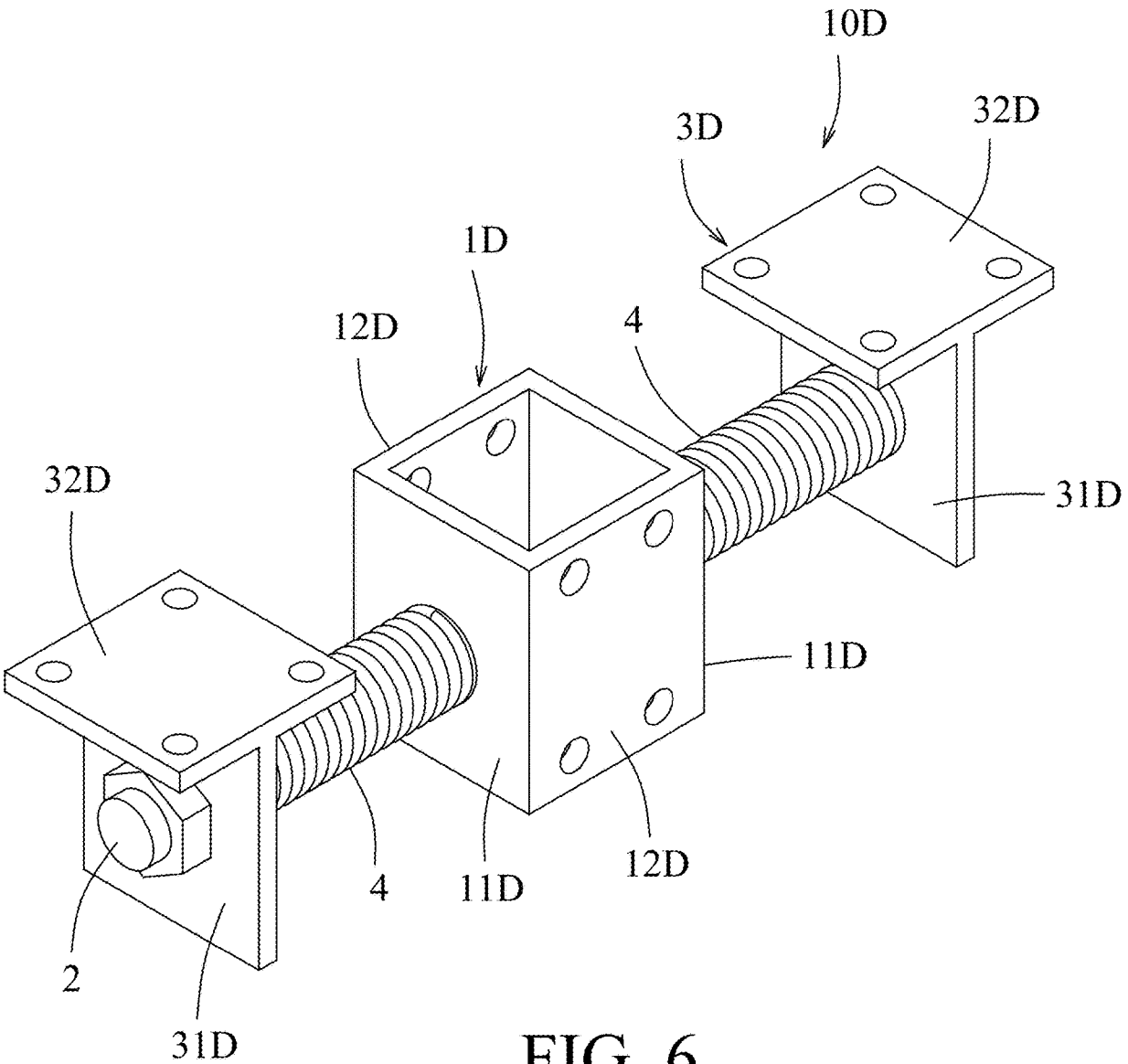
FIG. 6 is a perspective view of a self-centering energy dissipation device of a fifth embodiment according to the present disclosure.

Referring to FIG. 6, a self-centering energy dissipation device 10D of a fifth embodiment according to the present disclosure is similar to the first embodiment, and the difference between the fifth embodiment and the first embodiment resides in a configuration of the first base seat 1 and the second base seats 3. In the fifth embodiment, the first base seat 1D is substantially a rectangular cuboid and includes two abutment walls 11D permitting the main shaft 2 to extend therethrough, and two first attaching walls 12D connected between the abutment walls 11D. Each of the second base seats 3D is substantially T-shaped, and includes a connecting wall 31D connected to the main shaft 2, and a second attaching wall 32D transverse to and connected to one side of the connecting wall 31D.

Figure 7:
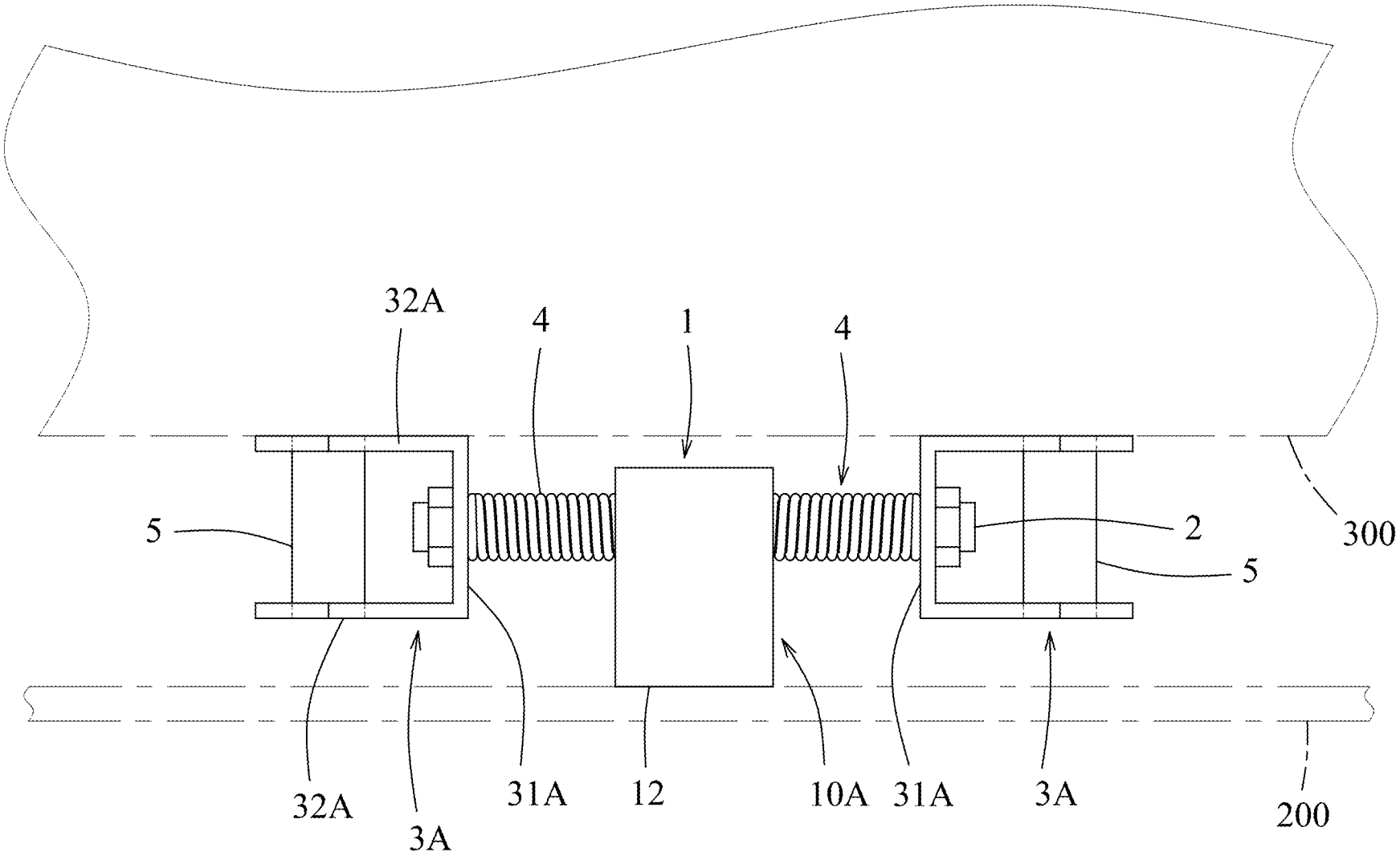
FIG. 7 is a schematic side view of the second embodiment mounted between a ground base and an architecture structure.

It should be noted that, in addition to being mounted to the precast slidable floor slab 100, the first to the fifth embodiments of the self-centering energy dissipation devices 10, 10A, 10B, 10C, 10D according to the present disclosure may be mounted between a foundation 200 (see FIG. 7) and an architecture structure 300 (see FIG. 7). Referring to FIGS. 3 and 7, taking the second embodiment as an example, the first attaching wall 12 of the first base seat 1 is connected to the foundation 200, and two fastening members 5 each connected to the second attaching walls 32A of a respective one of the second base seats 3A connect the second base seats 3A to the architecture structure 300. It should be noted that the architecture structure 300 which the second attaching walls 32A are connected to is parallel to the foundation 200 which the first attaching wall 12 is connected to. That is to say, in practical implementation, it is not necessary to have the first attaching wall 12 perpendicular to the second attaching walls 32 A (see FIG. 3) and the first attaching wall 12 may be parallel to or incline relative to the second attaching walls 32 according to actual demands. Accordingly, the self-centering energy dissipation device 10A is capable of providing a damping effect during earthquakes and restoring the foundation 200 and the architecture structure 300 to their initial positions after earthquakes. In this way, a portion of earthquake energy is dissipated, so less earthquake energy exerted on the architecture structure 300 is transmitted to an interior of the architecture structure 300, thereby reducing damage to structural elements in the architecture structure 300.

Figure 8:
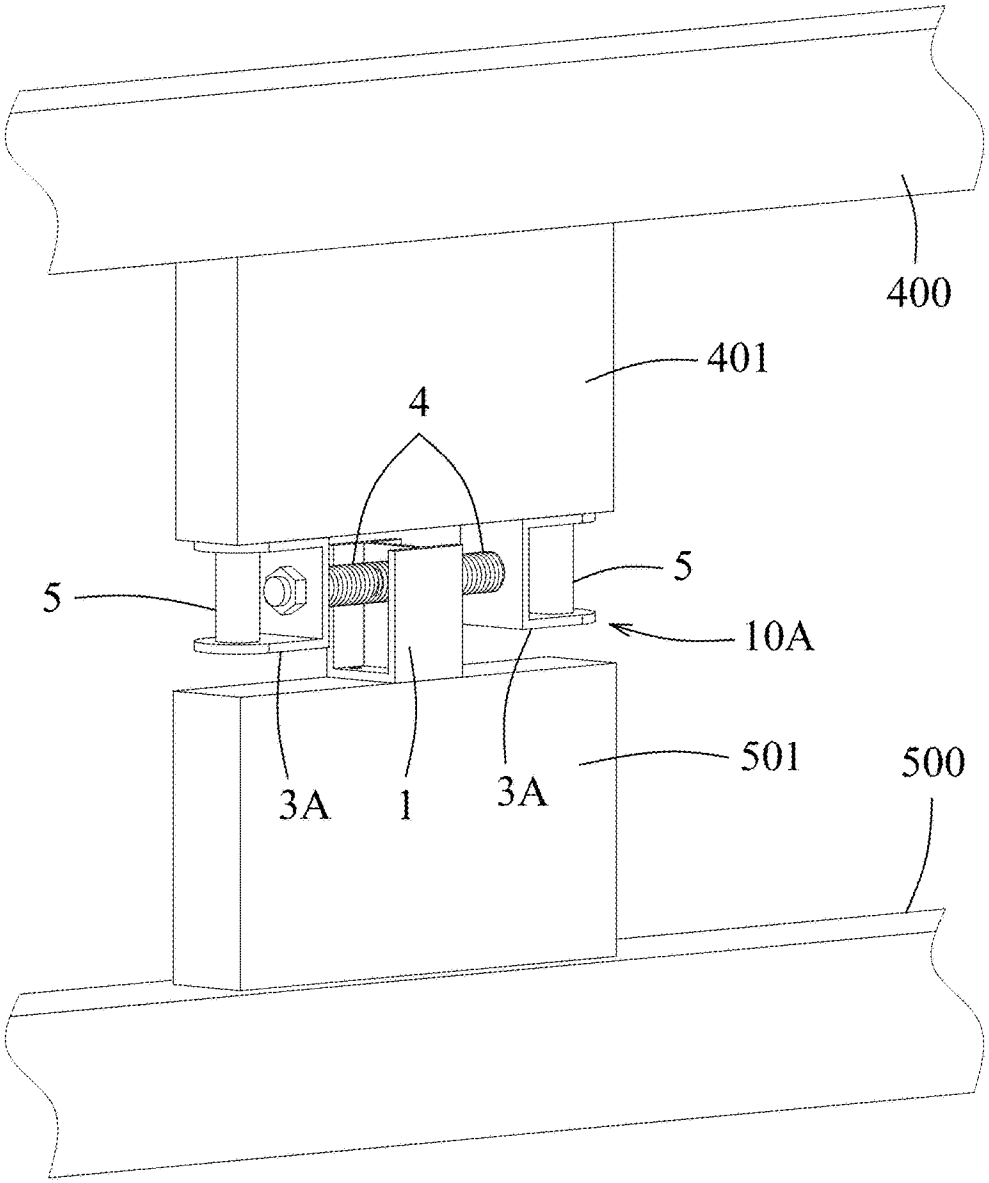
FIG. 8 is a schematic perspective view of a wall damping assembly of an embodiment according to the present disclosure mounted between an upper beam and a lower beam.

Referring to FIG. 8, a wall damping assembly of an embodiment according to the present disclosure is shown. The wall damping assembly is also adapted to be connected to the first object and the second object. The wall damping assembly includes one of the self-centering energy dissipation devices 10, 10A, 10B, 10C, 10D of the first to fifth embodiments of the present disclosure, an upper wall body 401 adapted to be connected to the first object, and a lower wall body 501 adapted to be connected to the second object. In this embodiment, an upper beam 400 serves as the first object and a lower beam 500 serves as the second object. That is to say, the upper beam 400 is connected to the upper wall body 401, and the lower beam 500 is connected to the lower wall body 501. Taking the self-centering energy dissipation device 10A of the second embodiment as an example, the self-centering energy dissipation device 10A is mounted between the upper beam 400 and the lower beam 500. The elastic members 4 are deformed and dissipate energy caused by relative movement between different floors during earthquakes and return to their initial positions after earthquakes, to thereby decrease a residual lateral deformation of the upper beam 400 and the lower beam 500. Each of the upper wall body 401 and the lower wall body 501 may be one of a concrete block, a square steel column, and an H-shaped steel column. In this embodiment, the upper wall body 401 and the lower wall body 501 are concrete blocks. In other embodiments, the upper wall body 401 and the lower wall body 501 may be respectively an upper box-shaped steel column and a lower box-shaped steel column that have the same appearance as the concrete blocks while are different in material.

Figure 9:
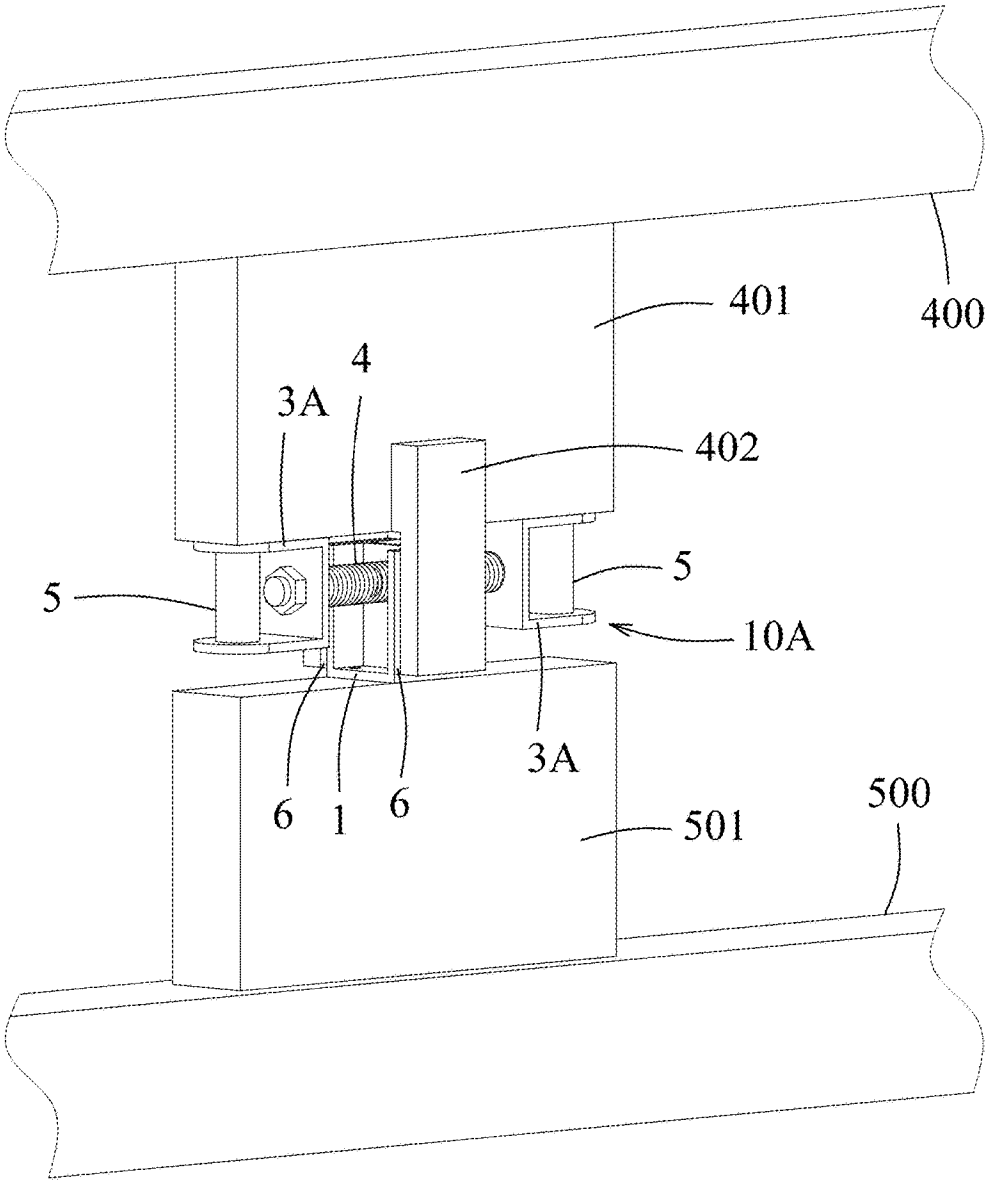
FIG. 9 is a schematic perspective view of a modification of the wall damping assembly of the present disclosure mounted between the upper beam and the lower beam.
Figure 10:
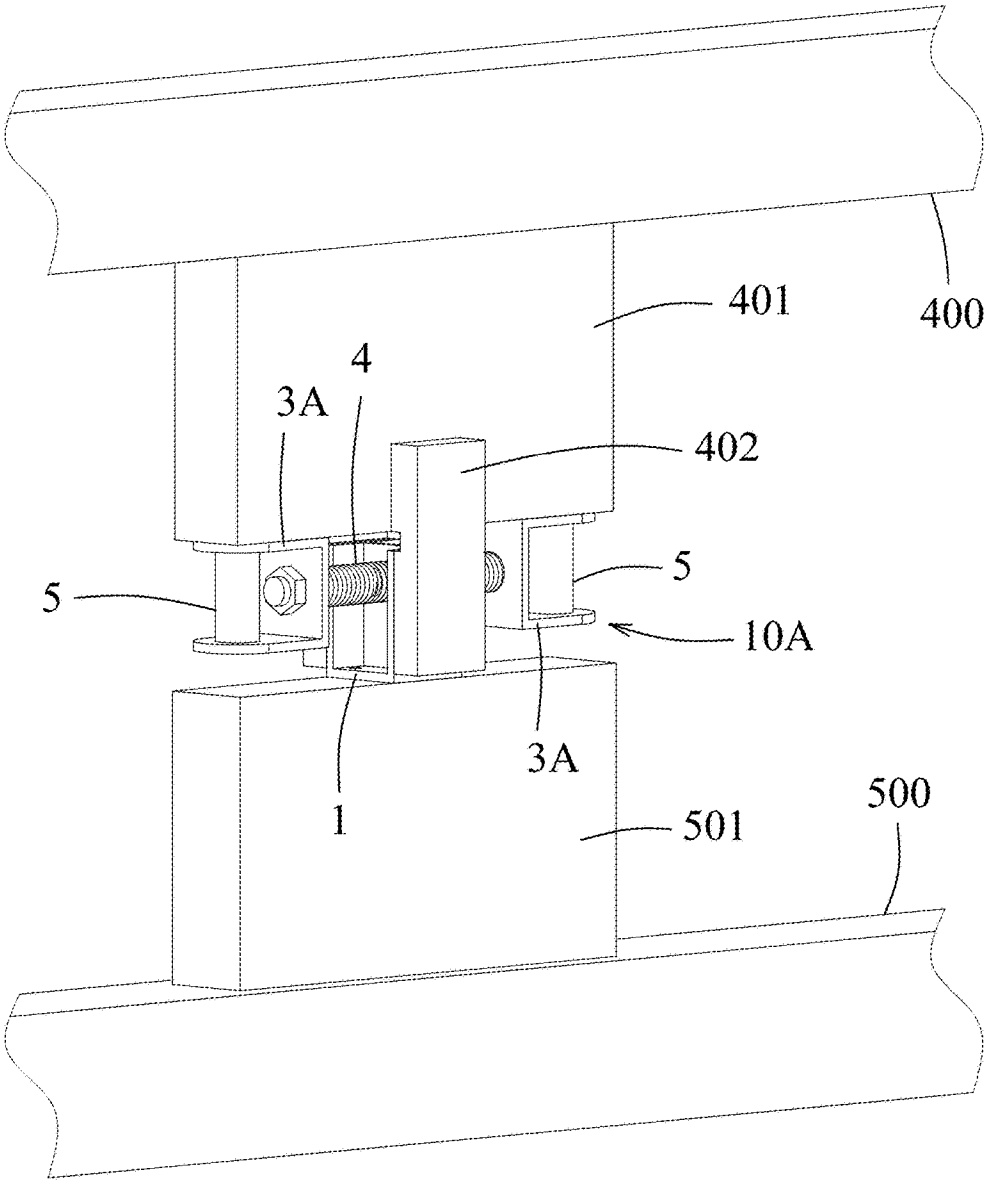
FIG. 10 is a view similar to FIG. 9, but illustrating a modification of the wall damping assembly.

Referring to FIG. 9, a modification of the wall damping assembly further includes two clamping blocks 402 extending from the upper wall body 401 toward the lower wall body 501, and two friction plates 6 each disposed between the first base seat 1 and a respective one of the clamping blocks 402, and abutting against the first base seat 1 and the respective one of the clamping blocks 402. In this way, the friction plates 6 and the clamping blocks 402 provide additional energy dissipation during earthquakes to thereby decrease damage to the structural elements. It should be noted that in other embodiments, as shown in FIG. 10, the fictional plates 6 may be omitted and the clamping blocks 402 abut respectively against two sides of the first base seat 1 that are opposite in a direction transverse to the main shaft 2. Lateral sides of each of the clamping blocks 402 may be deformed to dissipate energy caused by relative movement between different floors during earthquakes to thereby decrease damage to the structural elements. In this embodiment, the upper wall body 401 and the lower wall body 501 are concrete blocks and may be respectively an upper box-shaped steel column and a lower box-shaped steel column that have the same appearance as the concrete blocks while are different in material in other embodiments of the present disclosure.

Figure 11:
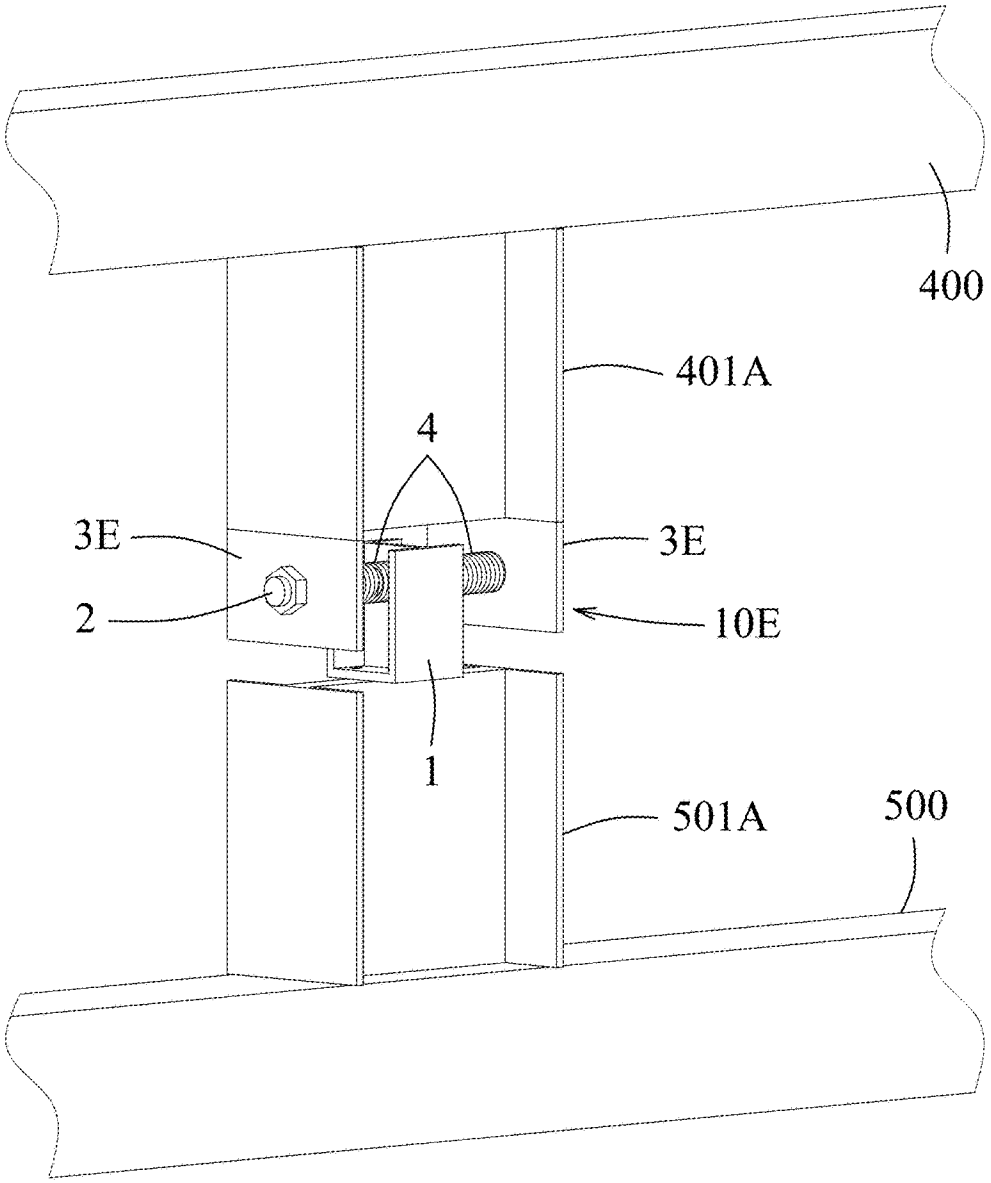
FIG. 11 is a schematic perspective view of another modification of the wall damping assembly of the present disclosure mounted between the upper beam and the lower beam.

Referring to FIG. 11, another modification of the wall damping assembly includes a self-centering energy dissipation device 10E of a sixth embodiment according to the present disclosure that is similar to the first embodiment. The difference between the sixth embodiment and the first embodiment resides in the configuration of the second base seats 3. In the sixth embodiment, each of the second base seats 3E is a board. In this modification, the upper wall body 401A and the lower wall body 501A are respectively an upper H-shaped steel column and a lower H-shaped steel column.

In summary, in the self-centering energy dissipation devices10 according to the present disclosure, by virtue of each of the elastic members 4 that abut against the first base seat 1 and the respective one of the second base seats 3, the first base seat 1 and the second base seats 3 may return to their initial positions even if relative movements occurs between the first base seat 1 and each of the second base seats 3 during earthquakes. In this way, permanent deformation of the top wall 101 and the beam 102 would be less likely to occur. In addition, the relative movements between the first base seat 1 and each of the second base seats 3 during earthquakes effectively dissipate a portion of earthquake energy exerted thereon during earthquakes.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A self-centering energy dissipation device adapted to be connected to a first object and a second object, said self-centering energy dissipation device comprising:

a first base seat adapted to be connected to the first object;

at least one main shaft extending through said first base seat;

two second base seats connected respectively and movably to two opposite ends of said at least one main shaft and adapted to be connected to the second object; and at least one pair of elastic members sleeved on said at least one main shaft, each of said at least one pair of elastic members having a first end abutting against said first base seat, and a second end abutting against a respective one of said second base seats, wherein said first base seat is substantially a rectangular cuboid, and includes an abutment wall permitting said at least one main shaft to extend therethrough and having two abutment surfaces that are opposite along said at least one main shaft, and that face respectively said second base seats;

a first attaching wall transverse to and connected to one side of said abutment wall; and two lateral walls transverse to said first attaching wall and said abutment wall, connected to two sides of said abutment wall that are opposite in a direction transverse to said at least one main shaft and two sides of said first attaching wall that are opposite in the direction transverse to said at least one main shaft, and said first end of each of said at least one pair of elastic members abuts against a respective one of said abutment surfaces of said abutment wall.

2. The self-centering energy dissipation device as claimed in claim 1, wherein each of said second base seats is a triangular prism, and includes a connecting wall connected to said at least one main shaft, a second attaching wall transverse to and connected to said connecting wall, and two sidewalls connected to two sides of said connecting wall that are opposite in a direction transverse to said at least one main shaft and two sides of said second attaching wall that are opposite in the direction transverse to said at least one main shaft, said sidewalls being triangular.

3. The self-centering energy dissipation device as claimed in claim 1, wherein each of said second base seats is substantially U-shaped, and includes a connecting wall connected to said at least one main shaft, and two second attaching walls transverse to said connecting wall and connected respectively to two sides of said connecting wall that are opposite in a direction transverse to said at least one main shaft.

4. A self-centering energy dissipation device adapted to be connected to a first object and a second object, said self-centering energy dissipation device comprising:

a first base seat adapted to be connected to the first object;

at least one main shaft extending through said first base seat;

two second base seats connected respectively and movably to two opposite ends of said at least one main shaft and adapted to be connected to the second object; and at least one pair of elastic members sleeved on said at least one main shaft, each of said at least one pair of elastic members having a first end abutting against said first base seat, and a second end abutting against a respective one of said second base seats, wherein said first base seat is substantially T-shaped, and includes an abutment wall permitting said at least one main shaft to extend therethrough, and a first attaching wall transverse to and connected to one side of said abutment wall.

5. The self-centering energy dissipation device as claimed in claim 4, wherein:

said at least one main shaft includes two main shafts;

said at last one pair of elastic members includes two pairs of elastic members; and each of said second base seats is substantially T-shaped, and includes a connecting wall connected to said main shafts, and a second attaching wall transverse to and connected to said connecting wall, and disposed between said main shafts.

6. A self-centering energy dissipation device adapted to be connected to a first object and a second object, said self-centering energy dissipation device comprising:

a first base seat adapted to be connected to the first object;

at least one main shaft extending through said first base seat;

two second base seats connected respectively and movably to two opposite ends of said at least one main shaft and adapted to be connected to the second object; and at least one pair of elastic members sleeved on said at least one main shaft, each of said at least one pair of elastic members having a first end abutting against said first base seat, and a second end abutting against a respective one of said second base seats, wherein said first base seat is substantially a rectangular cuboid, and includes two abutment walls permitting said at least one main shaft to extend therethrough, and two first attaching walls transverse to and connected to said abutment walls, and wherein each of said second base seats is substantially T-shaped, and includes a connecting wall connected to said at least one main shaft, and a second attaching wall transverse to and connected to one side of said connecting wall.

7. The self-centering energy dissipation device as claimed in claim 1, wherein said at least one pair of elastic members is one of a disc spring, a coil spring, and a vehicle spring.

8. The self-centering energy dissipation device as claimed in claim 1, wherein each of said second base seats is a board.

9. A wall damping assembly adapted to connect a first object and a second object, said wall damping assembly comprising:

an upper wall body adapted to be connected to the first object;

a lower wall body adapted to be connected to the second object; and said self-centering energy dissipation device as claimed in claim 1 disposed between said upper wall body and said lower wall body.

10. The wall damping assembly as claimed in claim 9, further comprising two clamping blocks that extend from said upper wall body toward said lower wall body, and that abut respectively against two sides of said first base seat opposite in a direction transverse to said at least one main shaft.

11. The wall damping assembly as claimed in claim 9, further comprising two clamping blocks and two friction plates, said clamping blocks extending from said upper wall body toward said lower wall body and being located respectively at two sides of said first base seat opposite in a direction transverse to said at least one main shaft, each of said friction plates being disposed between said first base seat and a respective one of said clamping blocks, and abutting against said first base seat and the respective one of said clamping blocks.

12. The wall damping assembly as claimed in claim 9, wherein each of said upper wall body and said lower wall body is one of a concrete block, a square steel column, and an H-shaped steel column.

* * * * *